US005487507A

United States Patent [19]

McDonald et al.

[11] Patent Number: 5,487,507

[45] Date of Patent: Jan. 30, 1996

[54] QUICK RELEASE AND CONNECT NOZZLE ASSEMBLY

[75] Inventors: Daniel P. McDonald, Arlington Heights, Ill.; John P. Smitherman, Salinas, Calif.

[73] Assignee: Illinois Tool Works Inc., Glenview, Ill.

[21] Appl. No.: 358,047

[22] Filed: Dec. 16, 1994

Related U.S. Application Data

[63] Continuation of Ser. No. 119,309, Sep. 13, 1993, abandoned.

[51] Int. Cl.[6] ..... B05B 15/06

[52] U.S. Cl. ..... 239/391; 239/600; 239/DIG. 19; 285/361; 285/376; 285/402

[58] Field of Search ..... 239/390, 391, 239/600, DIG. 19; 285/360, 361, 376, 401, 402

[56] References Cited

U.S. PATENT DOCUMENTS

| | | | |
|---|---|---|---|
| 1,702,943 | 2/1929 | Londe | 285/361 X |
| 1,938,571 | 12/1933 | Adams | 285/361 X |
| 2,449,659 | 9/1948 | Lane | 285/361 X |
| 3,799,453 | 3/1974 | Hart | 239/600 |
| 4,334,637 | 6/1982 | Baker et al. | 239/600 X |
| 4,438,884 | 3/1984 | O'Brien et al. | 239/600 |
| 4,754,929 | 7/1988 | Struve et al. | 239/600 X |
| 4,909,545 | 3/1990 | Hohol | 285/361 X |
| 5,078,325 | 1/1992 | Waryu et al. | 239/600 X |
| 5,121,930 | 6/1992 | Russell et al. . | |
| 5,199,649 | 4/1993 | Tolboll | 239/600 |

FOREIGN PATENT DOCUMENTS

| | | | |
|---|---|---|---|
| 208390 | 1/1987 | European Pat. Off. | 239/600 |
| 3632005 | 4/1988 | Germany | 239/600 |

*Primary Examiner*—William Grant
*Attorney, Agent, or Firm*—Schwartz & Weinrieb

[57] ABSTRACT

A quick release and connect nozzle assembly for use with a material dispensing head including a nozzle engagement member on a portion of the dispensing head, a nozzle member having an aperture therethrough for operable communication with the dispensing head to provide dispensing of the material in a predetermined pattern, and a connecting member integral with the nozzle member for engagement with the engagement member of the dispensing head, wherein the connecting member is operable by hand and provides quick release and connection of the nozzle member from the dispensing head so as to enable cleaning or replacement of the nozzle member as desired.

19 Claims, 1 Drawing Sheet

QUICK RELEASE AND CONNECT NOZZLE ASSEMBLY

This application is a continuation of application Ser. No. 08/119,309, filed Sep. 13, 1993, now abandoned.

BACKGROUND OF THE INVENTION

1. Field of the Invention

The present invention relates generally to material dispensing systems, and more particularly to a quick release and connect nozzle assembly for use with a modular adhesive dispensing head wherein the nozzle assembly can be readily disconnected and connected from the dispensing head by hand so as to enable changing of nozzles to provide a different pattern or for enabling cleaning, and wherein further the assembly provides a positive physical indication which can be felt by a user so as to insure that the assembly is properly seated on the dispensing head.

2. Description of the Related Art

Material dispensing systems, such as those utilized for dispensing hot-melt adhesives, are typically air activated and include a modular dispensing head which enables adhesives to be dispensed in precise quantities and patterns. An example of such a dispensing head is generally illustrated in U.S. Pat. No. 5,121,930 which is owned by the assignee herein.

As FIG. 2 of that patent illustrates, the bottom of the dispensing head includes an apertured nozzle in the form of a nut which is threaded onto threads formed on the dispensing head. If the nozzle becomes clogged or a different nozzle is desired, a hand-tool must be utilized to unthread the nozzle from the dispensing head.

The hand-tool, however, can be difficult to maneuver due to the close quarters of the dispensing system, and the nozzle can fall into other portions of the equipment and be lost and/or cause jamming of the equipment. Additionally, due to the heat generated in such nozzles from operation of the system, an operator can be burned if not careful.

It therefore would be desirable to provide a nozzle assembly which can be readily disconnected and connected from the dispensing head which does not require the use of hand-tools and provides a positive indication to a user that the nozzle is properly seated.

SUMMARY OF THE INVENTION

The invention provides a quick release and connect nozzle assembly for use with a material dispensing head. The assembly includes a nozzle engagement member on a portion of the dispensing head and a nozzle member having an aperture therethrough for operable communication with the dispensing head so as to provide dispensing of the material in a predetermined pattern. A connecting member is also integral with the nozzle member for engagement with the engagement member of the dispensing head which is operable by hand and provides quick release and connection of the nozzle member from the dispensing head so as to enable cleaning or replacement of the nozzle member as desired.

The assembly preferably includes a bayonet type connection between the nozzle member and the dispensing head which also provides a positive physical indication which can be felt by a user so as to indicate that the nozzle member is properly seated.

BRIEF DESCRIPTION OF THE DRAWINGS

Various other objects, features, and attendant advantages of the present invention will be more fully appreciated from the following detailed description, when considered in connection with the accompanying drawings in which like reference characters designate like or corresponding parts throughout the several views, and wherein.

DESCRIPTION OF THE PREFERRED EMBODIMENTS

Figure 3:
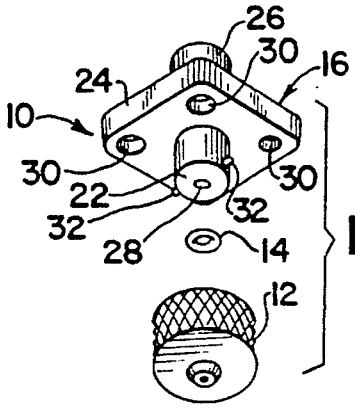
FIG. 3 is an exploded view of the nozzle assembly of FIG. 2.

Referring to FIG. 3, the nozzle assembly of the invention is generally designated by the reference numeral 10. The nozzle assembly 10 includes a nozzle member 12, an o-ring 14 and a needle seat 16. In use, the needle seat 16 is preferably connected to a modular dispensing head 18, generally illustrated in dotted lines in FIG. 4, which dispenses material, such as a hot-melt adhesive, in predetermined quantities.

Figure 1:
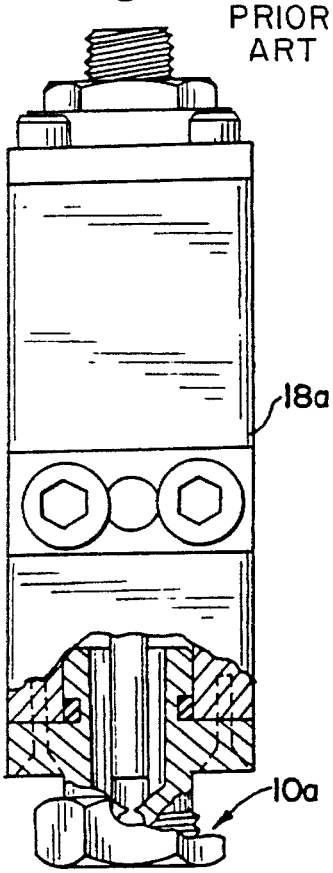
Fig. 1 PRIOR ART
FIG. 1 is a front elevational view of a prior art nozzle assembly illustrated as being attached to a modular hot-melt dispensing head with portions of the nozzle and dispensing head illustrated in cross-section.

FIG. 1 illustrates an existing nozzle assembly **10*a* which is threadedly connected to a modular dispensing head 18*a*. Thus, as described above, the nozzle assembly 10*a*** must be removed and installed utilizing hand-tools which can be difficult to accomplish.

Figure 2:
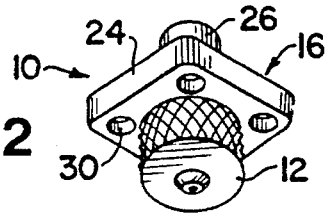
FIG. 2 is a bottom perspective view of a nozzle assembly of the invention.
Figure 4:
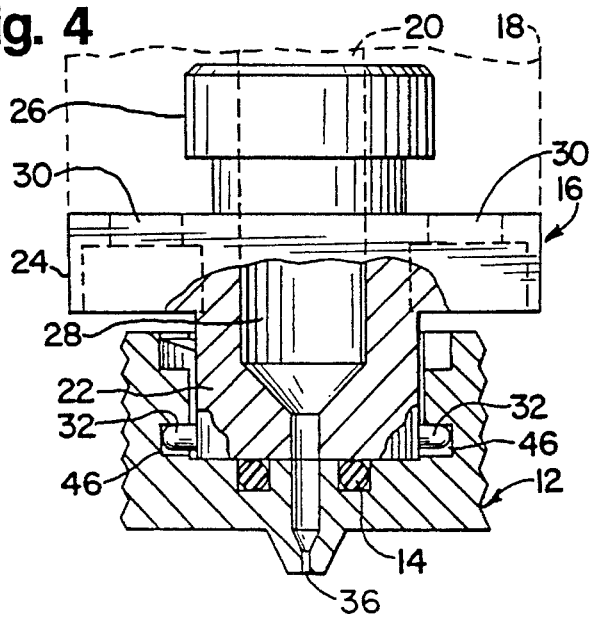
FIG. 4 is a longitudinal cross-sectional view of the nozzle assembly of the invention and a portion of a dispensing head generally illustrating the bayonet type connection therebetween.

As FIGS. 2–4 illustrate, the nozzle assembly 10 of the present invention, however, utilizes a quick disconnect and connect structure. Preferably, the quick connect structure is in the form of a bayonet type connection, but can vary so long as it functions as described herein.

As FIG. 4 illustrates, the dispensing head 18 includes a material flow path 20 through which a hot-melt adhesive flows in predetermined quantities and intervals. The needle seat 16 includes a cylindrical engagement portion 22, a shoulder 24, a seat portion 26, and a flow channel 28 formed therethrough for accepting material from the flow path 20 and providing the material to the nozzle member 12. To connect the needle seat 16 to the dispensing head 18, the shoulder 24 includes a plurality o of apertures 30 formed therethrough for accepting screws (not illustrated) which extend through the apertures 30 and engage threaded receptacles in the dispensing head 18.

To enable the nozzle member 12 to be connected to the needle seat 16, the cylindrical portion 22 of the needle seat 16 includes a pair of bayonet pins 32, one each on opposite sides of the cylindrical portion 22. As described in detail below, the pins 32 engage slots and guide tracks formed in the nozzle member 12 so as to provide the desired quick release and connecting.

Figure 5:
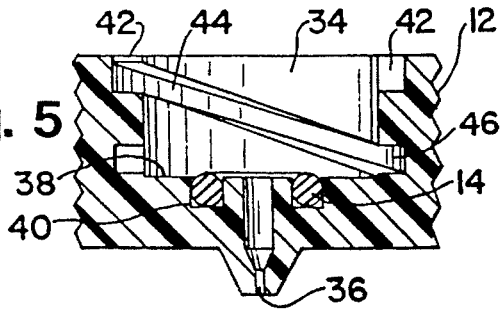
FIG. 5 is a longitudinal cross-sectional view of the nozzle member of the assembly of the invention illustrating a guide track for the bayonet pins.

As FIG. 5 illustrates, the nozzle member 12 is preferably circular in shape and includes a central bore 34 having an outlet orifice 36 and a bottom interior shoulder 38. To accommodate the o-ring 14, the interior shoulder 38 includes an annular recess 40 formed therein which extends about the orifice 36. The orifice 36 is illustrated as being circular and coaxial with respect to the central bore 34, but can be positioned to emit material in a variety of patterns and directions.

The nozzle member 12 is preferably made of metal, such as brass, and is knurled on its exterior to assist in gripping by hand. Alternatively, the nozzle member 12 can be made of a high temperature plastic, such as polyphenylene sulfide (PPS) or any other type of material. If made from plastic, the nozzle member 12 can be disposed of or recycled after use rather than being cleaned.

To accept the pins 32 and provide the desired bayonet type connection, the nozzle member 12 includes two slots 42 formed on opposite sides of the central bore 34. The slots 42 extend a predetermined distance into the nozzle member 12 and are slightly larger than the exterior dimensions of the pins 32.

To provide rotation between the pins 32 and the nozzle member 12 after the pins 32 are seated in the slots 42, the nozzle member 12 includes two semi-circular tracks 44, only one of which is illustrated in FIG. 5. Each track 44 accepts and guides a respective pin 32, extends around the nozzle member 12 and tapers downwardly with respect to FIG. 5 from the upper ends of slots 42 toward the interior shoulder 38.

To finally seat the nozzle member 12 with respect to the needle seat 16, the bottom of each track 44 includes a substantially flat semi-circular channel portion 46. The length of the channel 46 can vary and is slightly wider than the dimensions of the pins 32.

In operation, to connect the nozzle member 12 to the needle seat 16, the pins 32 of the needle seat 16 are first aligned with the slots 42 of the nozzle member 12. The nozzle member 12 is then inserted over the cylindrical portion 22 of the needle seat 16 until the pins 32 contact the bottom of the slots 42. The nozzle member 12 is then rotated in a clockwise direction causing the pins 32 to engage and ride within the tracks 44 thereby drawing the nozzle member 12 further over the cylindrical portion 22 of the seat 16 and toward the dispensing head 18.

Just before the pins 32 reach the bottom of the tracks 44 and enter the bottom channels 46, the cylindrical portion 22 of the needle seat 16 contacts the o-ring 14 disposed within the bottom region of the bore 34 of the nozzle member 12. Upon continued rotation of the nozzle member 12, the cylindrical portion 22 compresses the o-ring 14 thereby providing a seal therebetween. Further rotation of the nozzle member 12 causes the pins 32 to engage the end of the bottom channels 46.

As FIG. 4 illustrates, the compressive force provided by the o-ring 14 jams the pins 32 against top portions of the bottom channels 46 and substantially locks the nozzle o member 12 in place on the needle seat 16. It is also to be noted that upon engagement of the o-ring 14 with the cylindrical portion 22 of the needle seat 16, the compressive force provided by the o-ring 14 and the frictional engagement of the o-ring 14 with the cylindrical portion 22 can be felt by the user. When combined with engagement of the pins 32 with the end of the channels 46, a positive physical indication is provided to the user which assures that the nozzle member 12 is properly secured on the needle seat 16.

In order to disconnect the nozzle member 12 from the needle seat 16, the nozzle 12 is rotated in a counterclockwise direction until the pins 32 align with the slots 42. In this position, the nozzle member 12 can be removed from the needle seat 16.

Preferably, the bayonet type connection is provided so that full engagement between the nozzle member 12 and the needle seat 16 is provided as a result of one-half turn of the nozzle member 12 with respect to the needle seat 16. The particular degree of rotation of the nozzle member 12, however, can vary.

Figure 6:
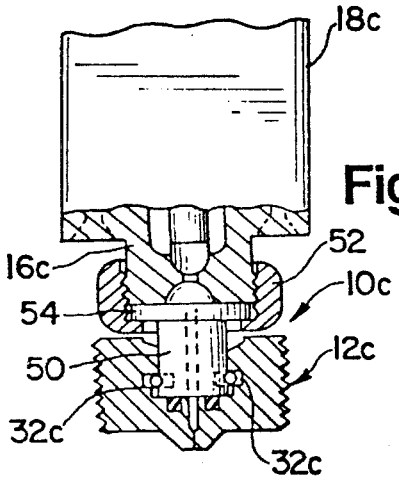
FIG. 6 is a front elevational view in partial section of another embodiment of the present invention utilized to retrofit existing dispensing heads.

FIG. 6 illustrates another embodiment of the present invention where common elements are designated by the same reference numerals as in the embodiment of FIGS. 2–5. In this embodiment, the nozzle assembly **10*c* is provided for retro-fitting existing threaded needle seats 16*c***.

The assembly **10*c* includes a nozzle member 12*c*, an adaptor 50, including pins 32*c*, and a nut 52. The nut 52 draws a shoulder 54 of the adaptor 50 into engagement with the needle seat 16*c*. The nozzle member 12*c* is then attached to the adaptor 50 in a manner similar to that of assembly 10 illustrated in FIGS. 2–5**.

It is to be noted that, upon loosening of the nut 52, the adaptor 50 and, in turn, the nozzle member **12*c*, can be rotated. This can be useful to adjust a nozzle member 12*c*** having an orifice which dispenses at a predetermined angle so as to vary the dispersion angle.

Modifications and variations of the present invention are possible in light of the above teachings. It therefore is to be understood that within the scope of the appended claims the invention may be practiced other than as specifically described.

What is claimed and desired to be secured by letters patent is:

1. A quick release and connect nozzle assembly for used with a material dispensing head, comprising:

nozzle engagement means disposed upon a portion of said dispensing head and comprising a pair of diametrically opposed, radially outwardly projecting pins having a predetermined axial thickness;

a nozzle member having an aperture defined therethrough for fluidic communication with said dispensing head so as to provide dispensing of a material in a predetermined pattern;

an annular recess defined within an interior end wall of said nozzle member;

a compressible O-ring disposed within said annular recess defined within said interior end wall of said nozzle member and having a portion thereof projecting outwardly from said annular recess defined within said interior end wall of said nozzle member;

connecting means integral with said nozzle member for engagement with said dispensing head projecting pins and comprising a pair of diametrically opposed entry slots defined at a first axial entrance position of said nozzle member; a pair of diametrically opposed terminal end channels, having an axial depth which is greater than said axial thickness of said radially outwardly projecting pins of said dispensing head, defined at a second axial position of said nozzle member which is axially spaced from said first axial position of said nozzle member at which said entry slots of said nozzle member are defined; and a pair of diametrically opposed, semi-circular tracks defined upon interior peripheral wall surfaces of said nozzle member and interconnecting said pair of diametrically opposed entry slots defined at said first axial entrance position and said pair of diametrically opposed terminal end channels defined at said second axial position such that a terminal end channel connected to a first one of said pair of semicircular tracks is disposed axially beneath an entry slot connected to a second one of said pair of semi-circular tracks; said diametrically opposed entry slots defined at said first axial entrance position having a predetermined axial depth which is substantially equal to said predetermined axial thickness of said diametrically opposed, radially outwardly projecting pins of said nozzle engagement means such that upon insertion of said diametrically opposed projecting pins of said nozzle engagement means into said entry slots of said nozzle member, immediate rotation of said nozzle member relative to said dispensing head will cause said nozzle member to be axially translated toward said dispensing head as a result of said diametrically opposed projecting pins of said nozzle engagement means moving circumferentially within said semi-circular tracks of said nozzle member from said first axial entrance position to said second axial terminal position, and said axial translation of said nozzle member toward said dispensing head will cause an end wall of said dispensing head to compress said outwardly projecting portion of said compressible O-ring disposed within said annular recess defined within said interior end wall of said nozzle member such that said nozzle member will be securely mounted upon said dispensing head as a result of said diametrically opposed projecting pins of said dispensing head having travelled through said semicircular tracks of said nozzle member so as to be disposed beneath said axial entrance entry slots, as well as said nozzle member being biased away from said dispensing head whereby said diametrically opposed projecting pins of said dispensing head will be disposed within portions of said terminal end channels of said nozzle member which are closest to said entry slots of said nozzle member so that said nozzle member is axially locked upon said dispensing head without axial play.

2. The nozzle assembly as defined in claim 1, wherein:

said engagement means comprising said projecting ping and said connecting means comprising said semi-circular tracks for receiving said pins define a bayonet type connection between said nozzle member and said dispensing head.

3. The nozzle as defined in claim 1 wherein said nozzle member is made of high temperature plastic.

4. A quick release and connect nozzle assembly for use with a material dispensing head having a threaded portion defined thereon, comprising:

an adaptor comprising a flange portion for abutting engagement with said dispensing head, and having a first passageway defined therein for receiving material to be dispensed from said dispensing head;

a threaded nut having a flange portion for engaging said flange portion of said adaptor and a threaded portion for threadedly engaging said threaded portion of said dispensing head whereby said adaptor is fixedly but removably secured to said dispensing head;

engagement means defined upon said adaptor comprising a pair of diametrically opposed, radially outwardly projecting pins having a predetermined axial thickness;

a nozzle member having a second passageway defined therein for receiving material to be dispensed from said adaptor;

an annular recess defined within an interior end wall of said nozzle member;

a compressible O-ring disposed within said annular recess defined within said interior end wall of said nozzle member and having a portion thereof projecting axially outwardly from said annular recess defined within said interior end wall of said nozzle member; and connecting means defined upon said nozzle member for engagement with said projecting pins of said adaptor and comprising a pair of diametrically opposed entry slots defined at a first axial entrance position of said nozzle member; a pair of diametrically opposed terminal end channels, having an axial depth which is greater than said axial thickness of said radially outwardly projecting pins of said adaptor, defined at a second axial position of said nozzle member which is axially spaced from said first axial position of said nozzle member at which said entry slots of said nozzle member are defined; and a pair of diametrically opposed, semi-circular tracks defined upon interior peripheral wall surfaces of said nozzle member and interconnecting said pair of diametrically opposed entry slots defined at said first axial entrance position and said pair of diametrically opposed terminal end channels defined at said second axial position such that a terminal end channel connected to a first one of said pair of semi-circular tracks is disposed axially beneath an entry slot connected to a second one of said pair of semi-circular tracks; whereupon insertion of said diametrically opposed projecting pins of said adaptor into said entry slots of said nozzle member, rotation of said nozzle member relative to said adaptor will cause said nozzle member to be axially translated toward said adaptor as a result of said diametrically opposed projecting pins of said adaptor moving circumferentially within said semi-circular tracks of said nozzle member from said first axial entrance position to said second axial terminal position, and said axial translation of said nozzle member toward said adaptor will cause an end wall of said adaptor to axially compress said outwardly projecting portion of said compressible O-ring disposed within said annular recess defined within said interior end wall of said nozzle member such that said nozzle member will be securely mounted upon said adaptor as a result of said diametrically opposed projecting pins of said adaptor having travelled through said semi-circular tracks of said nozzle member so as to be disposed beneath said axial entrance entry slots, as well as said nozzle member being biased away from said adaptor whereby said diametrically opposed projecting pins of said adaptor will be disposed within portions of said terminal end channels of said nozzle member which are closest to said entry slots of said nozzle member so that said nozzle member is axially locked upon said adaptor without axial play.

5. The nozzle assembly as set forth in claim 4, wherein:

said nozzle member is fabricated from a high-temperature plastic.

6. The nozzle assembly as set forth in claim 4, wherein said recess means defined within said interior end wall of said nozzle member annularly surrounds said second passageway of said nozzle member; and said O-ring means disposed within said recess means of said nozzle member is provided for sealing a joint connection defined between said nozzle member and said adaptor when said nozzle member is connected to said adaptor as a result of engagement of said engagement means of said adaptor and said connecting means of said nozzle member.

7. The nozzle assembly as set forth in claim 4, wherein:

said engagement means comprising said projecting pins and said connecting means comprising said semi-circular tracks for receiving said projecting pins define a bayonet type connection between said nozzle member and said dispensing head.

8. An assembly for quickly connecting and releasing a nozzle element to a material dispensing element, comprising:

engagement means, comprising a pair of diametrically opposed, radially projecting pins having a predetermined axial thickness, disposed upon one of said dispensing head and nozzle elements;

said nozzle element having an aperture defined therethrough for fluidic communication with said dispensing head element so as to provide dispensing of material in a predetermined pattern;

an annular recess defined within an interior end wall of said nozzle element;

a compressible O-ring disposed within said annular recess defined within said interior end wall of said nozzle element and having a portion thereof projecting outwardly from said annular recess defined within said interior end wall of said nozzle element; and connecting means integral with the other one of said dispensing head and nozzle elements for engagement with said projecting pins and comprising a pair of diametrically opposed entry slots defined at a first axial entrance position of said other one of said dispensing head and nozzle elements; a pair of diametrically opposed terminal end channels, having an axial depth which is greater than said axial thickness of said radially projecting pins, defined at a second axial position of said other one of said dispensing head and nozzle elements which is axially spaced from said first axial position of said other one of said dispensing head and nozzle elements at which said entry slots of said other one of said dispensing head and nozzle elements are defined; and a pair of diametrically opposed, semi-circular tracks defined upon interior peripheral wall surfaces of said other one of said dispensing head and nozzle elements and interconnecting said pair of diametrically opposed entry slots defined at said first axial entrance position and said pair of diametrically opposed terminal end channels defined at said second axial position such that a terminal end channel connected to a first one of said pair of semi-circular tracks is disposed axially beneath an entry slot connected to a second one of said pair of semi-circular tracks; said diametrically opposed entry slots defined at said first axial entrance position having a predetermined axial depth which is substantially equal to said predetermined axial thickness of said diametrically opposed, radially projecting pins of said one of said dispensing head and nozzle elements such that upon insertion of said diametrically opposed radially projecting pins of said one of said dispensing head and nozzle elements into said entry slots of said other one of said dispensing head and nozzle elements, immediate rotation of said nozzle element relative to said dispensing head element will cause said nozzle element to be axially translated toward said dispensing head element as a result of said diametrically opposed projecting pins of said one of said dispensing head and nozzle elements moving circumferentially within said semi-circular tracks of said other one of said dispensing head and nozzle elements from said first axial entrance position to said second axial terminal position, and said axial translation of said nozzle element toward said dispensing head element will cause an end wall of said dispensing head element to compress said outwardly projecting portion of said compressible O-ring disposed within said annular recess defined within said interior end wall of said nozzle element such that said nozzle element will be securely mounted upon said dispensing head as a result of said diametrically opposed projecting pins of said one of said dispensing head and nozzle elements having travelled through said semi-circular tracks of said other one of said dispensing head and nozzle elements so as to be disposed beneath said axial entrance entry slots, as well as said nozzle element being biased away from said dispensing head element whereby said diametrically opposed projecting pins of said one of said dispensing head and nozzle elements will be disposed within portions of said terminal end channels of said other one of said dispensing head and nozzle elements which are closest to said entry slots of said other one of said dispensing head and nozzle elements so that said nozzle element is axially locked upon said dispensing head without axial play.

9. An assembly as set forth in claim 8, wherein:

said engagement means are disposed upon said dispensing head element;

said connecting means are disposed upon said nozzle element; and said engagement means comprising said projecting pins and said connecting means comprising said semi-circular tracks for receiving said projecting pins together define a bayonet type connection between said dispensing head and said nozzle elements.

10. The nozzle assembly as set forth in claim 8, wherein:

said nozzle element is fabricated from a high-temperature plastic.

11. An assembly for quickly connecting and disconnecting a nozzle element to and from a material dispensing head having a threaded portion defined thereon, comprising:

an adaptor element comprising a flange portion for abutting engagement with said dispensing head, and having a first passageway defined therein for receiving material to be dispensed from said dispensing head;

a threaded nut having a flange portion for engaging said flange portion of said adaptor element, and a threaded portion for threadedly engaging said threaded portion of said dispensing head whereby said adaptor element is fixedly but removably secured to said dispensing head;

said nozzle element having a second passageway defined therein for receiving material to be dispensed from said adaptor element;

an annular recess defined within an interior end wall of said nozzle element;

a compressible O-ring disposed within said annular recess defined within said interior end wall of said nozzle member and having a portion thereof, projecting axially outwardly from said annular recess defined within said interior end wall of said nozzle element;

engagement means, comprising a pair of diametrically opposed, radially projecting pins having a predetermined axial thickness, disposed upon one of said adaptor and nozzle elements; and connecting means defined upon the other one of said adaptor and nozzle elements for engagement with said projecting pins of said one of said adaptor and nozzle elements and comprising a pair of diametrically opposed entry slots defined at a first axial entrance position of said other one of said adaptor and nozzle elements; a pair of diametrically opposed terminal end channels, having an axial depth which is greater than said axial thickness of said radially projecting pins, defined at a second axial position of said other one of said adaptor and nozzle elements which is axially spaced from said first axial position of said other one of said adaptor and nozzle elements at which said entry slots of said other one of said adaptor and nozzle elements are defined; and a pair of diametrically opposed, semi-circular tracks defined upon interior peripheral wall surfaces of said other one of said adaptor and nozzle elements and interconnecting said pair of diametrically opposed entry slots defined at said first axial entrance position and said pair of diametrically opposed terminal end channels defined at said second axial position such that a terminal end channel connected to a first one of said pair of semi-circular tracks is disposed axially beneath an entry slot connected to a second one of said pair of semi-circular tracks; whereupon insertion of said diametrically opposed radially projecting pins of said one of said adaptor and nozzle elements into said entry slots of said other one of said adaptor and nozzle elements, rotation of said nozzle element relative to said adaptor will cause said nozzle element to be axially translated toward said adaptor element as a result of said diametrically opposed projecting pins of said one of said adaptor and nozzle elements moving circumferentially within said semi-circular tracks of said other one of said adaptor and nozzle elements from said first axial entrance position to said second axial terminal position, and said axial translation of said nozzle element toward said adaptor element will cause an end wall of said adaptor element to compress said outwardly projecting portion of said compressible O-ring disposed within said annular recess defined within said interior end wall of said nozzle element such that said nozzle element will be securely mounted upon said adaptor element as a result of said diametrically opposed projecting pins of said one of said adaptor and nozzle elements having travelled through said semi-circular tracks of said other one of said adaptor and nozzle elements so as to be disposed beneath said axial entrance entry slots, as well as said nozzle element being biased away from said adaptor element whereby said diametrically opposed projecting pins of said one of said adaptor and nozzle elements will be disposed within portions of said terminal end channels of said other one of said adaptor and nozzle elements which are closest to said entry slots of said other one of said adaptor and nozzle elements so that said nozzle element is axially locked upon said adaptor without axial play.

12. The assembly as set forth in claim 11, wherein:

said engagement means is defined upon said adaptor element and comprises radially outwardly projecting pins; and said connecting means is defined upon said nozzle element and comprises track means for receiving said projecting pins of said adaptor element such that said projecting pins of said adaptor element and said track means of said nozzle element comprise a bayonet-type connection.

13. The nozzle assembly as set forth in claim 11, wherein:

said nozzle element is fabricated from a high-temperature plastic.

14. A quick release and connect nozzle assembly for use with a material dispensing head, comprising:

nozzle engagement means disposed upon a portion of said dispensing head and comprising a pair of diametrically opposed, radially outwardly projecting pins having a predetermined axial thickness;

a nozzle member having an aperture defined therethrough for fluidic communication with said dispensing head so as to provide dispensing of material in a predetermined pattern;

an annular recess defined within an interior end wall of said nozzle member;

a compressible O-ring disposed within said annular recess defined within said interior end wall of said nozzle member and having a portion thereof projecting axially outwardly from said annular recess defined within said interior end wall of said nozzle member; and connecting means integral with said nozzle member for engagement with said dispensing head projecting pins and comprising a pair of diametrically opposed entry slots defined at a first axial entrance position of said nozzle member; a pair of diametrically opposed terminal end channels, having an axial depth which is greater than said axial thickness of said radially outwardly projecting pins of said dispensing head, defined at a second axial position of said nozzle member which is axially spaced from said first axial position of said nozzle member at which said entry slots of said nozzle member are defined; and a pair of diametrically opposed, semi-circular tracks defined upon interior peripheral wall surfaces of said nozzle member and interconnecting said pair of diametrically opposed entry slots defined at said first axial entrance position and said pair of diametrically opposed terminal end channels defined at said second axial position such that a terminal end channel connected to a first one of said pair of semicircular tracks is disposed axially beneath an entry slot connected to a second one of said pair of semi-circular tracks; whereupon insertion of said diametrically opposed projecting pins of said nozzle engagement means into said entry slots of said nozzle member, rotation of said nozzle member relative to said dispensing head will cause said nozzle member to be axially translated toward said dispensing head as a result of said diametrically opposed projecting pins of said nozzle engagement means moving circumferentially within said semi-circular tracks of said nozzle member from said first axial entrance position to said second axial terminal position, and said axial translation of said nozzle member toward said dispensing head will cause an end wall of said dispensing head to compress said outwardly projecting portion of said compressible O-ring disposed within said annular recess defined within said interior end wall of said nozzle member such that said nozzle member will be securely mounted upon said dispensing head as a result of said diametrically opposed projecting pins of said dispensing head having travelled through said semi-circular tracks of said nozzle member so as to be disposed beneath said axial entrance entry slots, as well as said nozzle member being biased away from said dispensing head whereby said diametrically opposed projecting pins of said dispensing head will be disposed within portions of said terminal end channels of said nozzle member which are closest to said entry slots of said nozzle member so that said nozzle member is axially locked upon said dispensing head without axial play.

15. An assembly as set forth in claim 14, wherein:

said engagement means of said dispensing head and said connecting means of said nozzle member comprise a bayonet type connection.

16. The nozzle assembly as set forth in claim 14, wherein:

said nozzle element is fabricated from a high-temperature plastic.

17. An assembly for quickly connecting and releasing a nozzle element to and from a material dispensing head element, comprising:

engagement means, comprising a pair of diametrically opposed, radially projecting pins having a predetermined axial thickness, disposed upon one of said dispensing head and nozzle elements;

said nozzle element having an aperture defined therethrough for fluidic communication with said dispensing head element so as to provide dispensing of material in a predetermined pattern;

an annular recess defined within an interior end wall of said nozzle element;

a compressible O-ring disposed within said annular recess defined within said interior end wall of said nozzle element and having a portion thereof projecting axially outwardly from said annular recess defined within said interior end wall of said nozzle element; and connecting means integral with the other one of said dispensing head and nozzle elements for engagement with said projecting pins and comprising a pair of diametrically opposed entry slots defined at a first axial entrance position of said other one of said dispensing head and nozzle elements; a pair of diametrically opposed terminal end channels, having an axial depth which is greater than said axial thickness of said radially outwardly projecting pins, defined at a second axial position of said other one of said dispensing head and nozzle elements which is axially spaced from said first axial position of said other one of said dispensing head and nozzle elements at which said entry slots of said other one of said dispensing head and nozzle elements are defined; and a pair of diametrically opposed, semi-circular tracks defined upon interior peripheral wall surfaces of said other one of said dispensing head and nozzle elements and interconnecting said pair of diametrically opposed entry slots defined at said first axial entrance position and said pair of diametrically opposed terminal end channels defined at said second axial position such that a terminal end channel connected to a first one of said pair of semi-circular tracks is disposed axially beneath an entry slot connected to a second one of said pair of semi-circular tracks; whereupon insertion of said diametrically opposed radially projecting pins of said one of said dispensing head and nozzle elements into said entry slots of said other one of said dispensing head and nozzle elements, rotation of said nozzle element relative to said dispensing head element will cause said nozzle element to be axially translated toward said dispensing head element as a result of said diametrically opposed projecting pins of said one of said dispensing head and nozzle elements moving circumferentially within said semi-circular tracks of said other one of said dispensing head and nozzle elements from said first axial entrance position to said second axial terminal position, and said axial translation of said nozzle element toward said dispensing head element toward said dispensing head element will cause an end wall of said dispensing head element to compress said outwardly projecting portion of said compressible O-ring disposed within said annular recess defined within said interior end wall of said nozzle element such that said nozzle element will be securely mounted upon said dispensing head as a result of said diametrically opposed projecting pins of said one of said dispensing head and nozzle elements having travelled through said semi-circular tracks of said other one of said dispensing head and nozzle elements so as to be disposed beneath said axial entrance entry slots, as well as said nozzle element being biased away from said dispensing head element whereby said diametrically opposed projecting pins of said one of said dispensing head and nozzle elements will be disposed within portions of said terminal end channels of said other one of said dispensing head and nozzle elements which are closest to said entry slots of said other one of said dispensing head and nozzle elements so that said nozzle element is axially locked upon said dispensing head element without axial play.

18. An assembly as set forth in claim 17, wherein:

said engagement means are disposed upon said dispensing head element;

said connecting means are disposed upon said nozzle element; and said engagement means comprising said projecting pins and said connecting means comprising said semi-circular tracks for receiving said projecting pins together define a bayonet type connection between said dispensing head and nozzle elements.

19. The assembly as set forth in claim 17, wherein:

said nozzle element is fabricated from a high-temperature plastic.

* * * * *